US012758852B2

(12) United States Patent
Garner

(10) Patent No.: US 12,758,852 B2
(45) Date of Patent: Oct. 13, 2026

(54) ORAL APPLIANCE

(71) Applicant: Dental Choice Holdings LLC, Louisville, KY (US)

(72) Inventor: Dena P. Garner, Isle of Palms, SC (US)

(73) Assignee: Dental Choice Holdings LLC, Louisville, KY (US)

( * ) Notice: Subject to any disclaimer, the term of this patent is extended or adjusted under 35 U.S.C. 154(b) by 632 days.

(21) Appl. No.: 17/580,835

(22) Filed: Jan. 21, 2022

(65) Prior Publication Data

US 2023/0233923 A1 Jul. 27, 2023

(51) Int. Cl.
*A63B 71/08* (2006.01)

(52) U.S. Cl.
CPC ..... *A63B 71/085* (2013.01)

(58) Field of Classification Search
CPC ..... A61F 5/56; A61F 5/566; A61F 2005/563; A63B 71/085; A63B 2071/086; A63B 2071/088; A61C 7/08; Y10S 602/902
USPC ..... 128/848, 859, 861, 862
See application file for complete search history.

(56) References Cited

U.S. PATENT DOCUMENTS

| | | | |
|---|---|---|---|
| 2,659,366 | A | 11/1953 | Savarese |
| 3,124,129 | A | 3/1964 | Grossberg |
| 3,496,936 | A | 2/1970 | Gores |
| 3,924,638 | A | 12/1975 | Mann |
| 4,519,386 | A | 5/1985 | Sullivan |
| 4,955,393 | A | 9/1990 | Adell |
| 5,052,409 | A | 10/1991 | Tepper |
| 5,194,003 | A | 3/1993 | Garay et al. |
| 5,316,020 | A | 5/1994 | Truffer |
| 5,406,963 | A | 4/1995 | Adell |
| 5,536,168 | A | 7/1996 | Bourke |
| 5,584,687 | A | 12/1996 | Sullivan |
| 5,718,575 | A | 2/1998 | Cross, III |
| 5,752,822 | A | 5/1998 | Robson |
| 5,865,619 | A | 2/1999 | Cross, III et al. |
| 5,879,155 | A | 3/1999 | Kittlesen |
| 6,012,919 | A | 1/2000 | Cross, III et al. |
| 6,092,524 | A | 7/2000 | Barnes |
| 6,196,840 | B1 | 3/2001 | Zentz et al. |
| 6,237,601 | B1 | 5/2001 | Kittelsen et al. |
| 6,241,518 | B1 | 6/2001 | Sullivan |
| 6,257,239 | B1 | 7/2001 | Kittelsen et al. |
| 6,371,758 | B1 | 4/2002 | Kittlesen |

(Continued)

FOREIGN PATENT DOCUMENTS

| | | | |
|---|---|---|---|
| CA | 2668913 | A1 | 5/2008 |
| CN | 102123678 | B | 7/2011 |

(Continued)

OTHER PUBLICATIONS

Bolzern Frank, Appliance for the Treatment of Snoring and Obstructive Sleep Apnea, Jul. 5, 2019 (Year: 2019).*

(Continued)

*Primary Examiner* — Alireza Nia
*Assistant Examiner* — Robin Han
(74) *Attorney, Agent, or Firm* — Dinsmore & Shohl LLP

(57) ABSTRACT

Present embodiments related to an oral appliance. More specifically, but without limitation, present embodiments relate to an oral appliance which improves aerobic performance when used during workouts or other athletic endeavors.

18 Claims, 7 Drawing Sheets

(56) References Cited

U.S. PATENT DOCUMENTS 6,415,794 B1 7/2002 Kittelsen
6,467,484 B1 10/2002 De Voss
6,491,036 B2 12/2002 Cook
6,505,626 B2 1/2003 Kittelsen et al.
6,505,627 B2 1/2003 Kittelsen et al.
6,505,628 B2 1/2003 Kittelsen et al.
6,508,251 B2 1/2003 Kittelsen et al.
6,510,853 B1 1/2003 Kittelsen et al.
6,533,943 B1 3/2003 Jones et al.
6,539,943 B1 4/2003 Kittelsen
6,553,996 B2 4/2003 Kittelsen
6,581,604 B2 6/2003 Cook
6,588,430 B2 7/2003 Kittelsen et al.
6,598,365 B2 7/2003 Abraham et al.
6,598,605 B1 7/2003 Kittlesen et al.
6,626,180 B1 9/2003 Kittelsen
6,675,806 B2 1/2004 Kittelsen et al.
6,675,807 B2 1/2004 Kittelsen et al.
6,691,710 B2 2/2004 Kittelsen et al.
D496,154 S 9/2004 Herman et al.
D496,498 S 9/2004 Kittelsen et al.
D496,499 S 9/2004 Kittelsen
6,820,623 B2 11/2004 Cook
6,830,051 B1 * 12/2004 Lesniak ..... A61F 5/566 128/862
D500,897 S 1/2005 Herman
D500,898 S 1/2005 Herman
D501,062 S 1/2005 Herman
6,837,246 B1 1/2005 DeLuke
D502,995 S 3/2005 Cook
6,941,952 B1 9/2005 Rush, III
7,059,332 B2 6/2006 Eli
7,299,804 B2 11/2007 Kittelsen et al.
D570,724 S 6/2008 Kittelsen
D586,252 S 2/2009 Kittelsen
7,549,423 B1 6/2009 Hirshberg
7,798,149 B2 9/2010 Haduong
7,890,193 B2 2/2011 Tingey
7,950,394 B2 5/2011 Elkin
D641,478 S 7/2011 Belvedere
7,975,701 B2 7/2011 Bergersen
8,074,658 B2 12/2011 Kittelsen et al.
8,075,309 B2 12/2011 Li et al.
8,113,206 B2 * 2/2012 Roettger ..... A61F 5/566 128/857
8,474,462 B2 7/2013 Makower
8,567,408 B2 10/2013 Roettger
8,667,971 B2 3/2014 Makkar et al.
8,667,972 B2 3/2014 Makkar et al.
8,689,797 B2 4/2014 Elkin
8,839,795 B2 9/2014 Von Arx
9,022,903 B2 5/2015 Rafih et al.
9,138,376 B2 9/2015 Allen
D743,108 S 11/2015 Charlton
D743,109 S 11/2015 Charlton
9,668,827 B2 6/2017 Roettger
9,968,419 B2 5/2018 Alvarez et al.
10,328,225 B2 6/2019 Garner
11,083,956 B1 8/2021 Varga
11,129,746 B2 9/2021 Alvarez et al.
11,260,189 B2 3/2022 Garner
11,266,802 B2 3/2022 Garner
11,285,035 B2 3/2022 Alvarez et al.
2002/0066454 A1 6/2002 Kittelsen et al.
2002/0114694 A1 8/2002 Teplanszky
2002/0144687 A1 10/2002 Kittelsen et al.
2002/0144688 A1 10/2002 Kittelsen et al.
2002/0144689 A1 10/2002 Kittelsen et al.
2002/0144690 A1 10/2002 Kittelsen et al.
2002/0144691 A1 10/2002 Kittelsen et al.
2002/0144692 A1 10/2002 Kittelsen et al.
2002/0144693 A1 10/2002 Kittelsen et al.
2002/0144695 A1 10/2002 Cook
2002/0192617 A1 12/2002 Phan
2003/0040679 A1 2/2003 Weber et al.
2003/0101999 A1 6/2003 Kittelsen
2004/0094165 A1 5/2004 Cook
2004/0107970 A1 6/2004 Kittelsen et al.
2004/0181166 A1 9/2004 Williford et al.
2004/0250817 A1 12/2004 Kittelsen et al.
2005/0115571 A1 6/2005 Jacobs
2005/0241646 A1 11/2005 Sotos et al.
2005/0284489 A1 12/2005 Ambis
2006/0078840 A1 4/2006 Robson
2006/0289013 A1 12/2006 Keropian
2007/0261701 A1 11/2007 Sanders
2007/0289600 A1 12/2007 Li
2008/0099029 A1 5/2008 Lamberg
2008/0138755 A1 6/2008 Jansheski
2008/0210244 A1 9/2008 Keropian
2009/0126742 A1 5/2009 Summer
2009/0130635 A1 5/2009 Tortorici
2009/0191502 A1 7/2009 Cao et al.
2009/0221884 A1 9/2009 Ryan
2009/0308403 A1 12/2009 Roettger et al.
2010/0147315 A1 6/2010 Chodorow
2010/0252053 A1 10/2010 Garner et al.
2010/0269836 A1 10/2010 Roettger et al.
2011/0017221 A1 1/2011 Garner et al.
2011/0039223 A1 2/2011 Li
2011/0067710 A1 3/2011 Jansheski
2011/0114100 A1 5/2011 Ramiro et al.
2012/0090625 A1 4/2012 Evans et al.
2012/0165862 A1 6/2012 Allen
2012/0305008 A1 12/2012 Garner et al.
2012/0325224 A1 12/2012 Elkin
2013/0042876 A1 2/2013 Hermanson
2013/0066236 A1 3/2013 Herman
2013/0068237 A1 3/2013 Herman
2013/0074851 A1 3/2013 Herman
2013/0081640 A1 4/2013 Herman
2013/0298916 A1 11/2013 Alvarez
2014/0026896 A1 1/2014 Roettger et al.
2014/0080083 A1 3/2014 Mathieu
2014/0090652 A1 4/2014 Hakimi
2014/0135868 A1 5/2014 Bashyam
2014/0272761 A1 9/2014 Lowe
2015/0079530 A1 3/2015 Bergersen
2015/0272773 A1 * 10/2015 Rico ..... A61F 5/566 128/848
2015/0366636 A1 12/2015 Zampino
2016/0158628 A1 6/2016 Layzell
2016/0230007 A1 8/2016 Johnson
2016/0367342 A1 12/2016 Alvarez
2017/0020716 A1 1/2017 Hart et al.
2018/0207022 A1 7/2018 Alvarez et al.
2018/0344508 A1 * 12/2018 Brown ..... A61F 5/566
2018/0353838 A1 12/2018 Padavan
2019/0262565 A1 8/2019 Garner
2019/0374734 A1 12/2019 Garner
2020/0261187 A1 * 8/2020 Simonetti ..... A61C 7/08
2020/0261255 A1 * 8/2020 Huang ..... A63B 71/085
2022/0008244 A1 1/2022 Hart et al.
2022/0087854 A1 * 3/2022 Knutzen ..... A61F 5/566
2022/0096767 A1 3/2022 Garner
2023/0233923 A1 7/2023 Garner
2024/0374352 A1 11/2024 Garner
2025/0018140 A1 1/2025 Garner

FOREIGN PATENT DOCUMENTS

DE 29509294 5/1995
DE 102004009883 9/2005
FR 2872406 3/2007
GB 2444588 3/2009
GB 2513902 A 11/2014
JP 2006519656 A 8/2006
JP 2011512177 A 4/2011
JP 2011514185 A 5/2011
JP 5008394 B2 8/2012
JP WO2014188517 A 2/2017
WO 2009012243 1/2009
WO 2009128339 10/2009
WO 2009135210 11/2009

(56) References Cited

FOREIGN PATENT DOCUMENTS

| | | | |
|---|---|---|---|
| WO | 2011153172 | 8/2011 | |
| WO | 2011153173 | 8/2011 | |
| WO | 2011153174 | 8/2011 | |
| WO | 2011153175 | 8/2011 | |
| WO | WO-2020039276 A1 * | 2/2020 | ..... A61F 5/566 |

OTHER PUBLICATIONS

Moses D.D.S., Allen J.; Evolution of Theory on Oral Appliances and Exercises for Sleep Apnea and Snoring; Sleep Diagnosis and Therapy, vol. 5 No. 7, Nov.-Dec. 2010.
Fogel, Robert B., et al.; Within-Breath Control of Genioglossal Muscle Activation in Humans: Effect of Sleep-Wake State; The Journal of Physiology 550, 899-910; Aug. 1, 2003 (published online as of Jun. 13, 2003).
Garner, Dena P., The Effects of Mouthpiece Use on Gas Exchange Parameters During Steady-State in College-Aged Men and Woman, Journal of the American Dental Association 142(9), Sep. 2011.
Cheng, S., Movement of the Tongue During Normal Breathing in Awake, Healthy Humans, The Journal of Physiology 586, 4283-4294, Sep. 1, 2008 (published online as of Jul. 17, 2008).
Okeson; "Fundamentals of Occlusion and Temporomandibular Disorders" (The C. V. Mosby Company, St. Louis, 1985), p. 333-340.
Lucia; "Modern Gnathological Concepts—Updated" (Quintessence Publishing Co., Inc., Chicago, 1983), Chapters 2, 3, and 4 (pp. 29-63).
Shore; A Mandibular autorepositioning Appliance, JADA, vol. 75, Oct. 1967.
Shore, Nathan Allen, "Temporomandibular Joint Dysfunction and Occlusal Equilibration", J.B. Lippincott Compan, 1976 [Second Edition], Philadelphia, pp. 237-241.
Various Authors, Compednium of Continuing Education in Dentistry, 30(2) Aegis Publications LLC, 2009.
D.P. Garner & E.J. Mcdivitt, Effects of Mouthpiece Use on Lactate and Cortisol Levels During and After 30 Minutes of Treadmill Running, Open Access Journal of Science and Technology, vol. 3, Agial Publishing House, 2015.
D.P. Garner, Effects of Various Mouthpieces on Respiratory Physiology During Steady-State Exercise in College-Aged Subjects, Sports Dentistry & Mouthgards, Academy of General Dentistry, Nov./Dec. 2015.
A.J. Miller, Oral and Pharyngeal Reflexes in the Mammalian Nervous System: Their Diverse Range in Complexity and Theh Pivotal Role of the Tongue, Crit. Rev. Oral Biol. Med., Inern'l & American Assoc. for Dental Research, 13(5): 409-425, 2002.
J.P. Saboisky, B.J. Luu, J.E. Butler, S.C. Gandevia, Effects of Tongue Position and Lung Volume on Voluntary Mximal Tongue Protrusion Force in Humands, Respiratory Physiology & Neurobiology, Elsevier, Dec. 4, 2014.
J.E. Schmidt, C.R. Carlson, A.R. Usery, A.S. Quevedo, Effects of Tongue Position on Mandibular Muscle Activity and Heart Rate Function, Oral Surg. Oral Med. Oral Path. Oral Radiol. Endod, Mosby Inc., 108:881-888, 2009.
D.P. Gardner, W.D. Dudgeon, E.J. Mcdivitt, the Effects of Mouthpiece Use on Cortisol Levels During an Intense Bout of Resistance Exercise, J. of Strength and Conditioning Research, National Strench & Conditioning Assoc., 25(10), 2011.
Garner, Dudgeon, Mcdivitt and Scheett, the Effects of Mouthpiece Use on Gas Exchange Parameters During Steady-State Exercise in College-Aged Men and Women. J Am. Dent. Assoc., Am Dental Assoc., 142(9) 1041-1047, 2011.
Murakami, S., Maeda, Y., Ghanem, A., Uchiyama, Y., & Kreilborg, S. Influence of Mouthguard on Temporomandibular Joint. Scand J Med Sports, 18, 591-595 (2008).
Pae, A., Yoo, R., Noh, K, Pake, J., & Kwon, K. the Effects of Mouthguards on the Athletic Ability of Professional Golfers. Dnen Traumatol, John Wiley & Son, 29, 47-51 (2013).
Freedman, George; The Dentist's Role in Sport Performance Mouthwear, Oral Health, Dec. 1, 2010 (https://www.oralhealthgroup.com/features/the-dentists-role-in-sport-performance-mouthwear).
www.underarmour.com; UA Performance Mouthwear (Year: 2009).
U.S. Appl. No. 16/406,324, filed May 8, 2019 titled "Dental Appliance Apparatus and Respiratory Enhancement".
U.S. Appl. No. 16/516,958, filed Jul. 19, 2019 titled "Single Arch Dental Device and Method of Manufacture".
U.S. Appl. No. 61/132,588, filed Jun. 19, 2008 titled Composite oral appliances and methods for manufacture.
U.S. Appl. No. 16/519,665, filed Jul. 23, 2019 titled "Methods of Respiratory Enhancement Using a Dental Appliance".
Amazon Customer Reviews—New Age Performance—Products; Publication: Oct. 11, 2024 / 7 pages (Retrieved from the internet Jan. 21, 2025) (Earliest review date: Jan. 21, 2019).
LA Times; Money where mouth is; Publication: Nov. 6, 2009; URL: https://www.latimes.com/archives/la-xpm-2009-nov-06-sp-nfl-farmer6-story.html / 5 pages (Retrieved from the internet Jan. 21, 2025).
Dragons Den Pitch—New Age Performance; Dragon's Den season 12 (Canadian version) premiered on Sep. 27, 2017; URL: https://www.cbc.ca/dragonsden/pitches/new-age-performance / 3 pages (Retrieved from the internet Jan. 21, 2025).
Spotlight on Business Magazine; New Age Performance; Interview in Oct. 2017 (days after Dragon's Den season 12 (Canadian version) premiered on Sep. 27, 2017); URL: https://spotlightonbusinessmagazine.com/real-science-real-results-real-people-new-age-performance/ / 7 pages (Retrieved from the internet Jan. 21, 2025).

* cited by examiner

ORAL APPLIANCE

CROSS REFERENCE TO RELATED APPLICATION

None.

BACKGROUND

1. Field of the Invention

Present embodiments related to an oral appliance. More specifically, but without limitation, present embodiments relate to an oral appliance which improves aerobic performance when used during workouts or other athletic endeavors.

2. Description of the Related Art

High intensity and endurance athletes continually desire to improve performance achievements. One way to improve performance is to improve breathing performance by providing the lungs with additional air supply, which in turn provides additional oxygen to muscles. However, there are limited manners in which to provide additional air. The air supply may in part be limited in part by respiratory rate. However, increasing respiratory rates may also make the body work harder but not on the performance goal.

It would be desirable to improve aerobic performance independent of increased respiratory rates. It would be desirable to decrease respiratory rate. It also would be desirable to reduce cortisol build up in the muscles.

The information included in this Background section of the specification, including any references cited herein and any description or discussion thereof, is included for technical reference purposes only and is not to be regarded as subject matter by which the scope of the invention is to be bound.

SUMMARY

The present application discloses one or more of the features recited in the appended claims and/or the following features which alone or in any combination, may comprise patentable subject matter.

Present embodiments provide an oral appliance which improves aerobic performance by providing more airflow to the user's lungs. Present embodiments provide an oral appliance which reduces respiratory rates. Present embodiments provide an oral appliance which improves muscle endurance and which reduces cortisol build up.

According to some embodiments, an oral appliance may comprise a first body having a first lingual wall extending between an anterior direction and a posterior direction and a first facial wall extending between the anterior direction and the posterior direction, an first occlusal surface extending between the first lingual wall and the first facial wall. A second body may have a second lingual wall extending between the anterior direction and the posterior direction and a second facial wall extending between the anterior direction and the posterior direction. A second occlusal surface may extend between the second lingual wall and the second facial wall. A connector may extend between the first body and the second body and upper lingual corners of the body. And, a first lobe may extend from an anterior end of the first facial wall and a second lobe extending from an anterior end of the second facial wall.

According to some optional embodiments, the following features may be combined with the oral appliance either individually or in combination with other of the following optional features and the oral appliance. The first body, the second body, and the connector may define an external portion. The oral appliance may further comprise an internal portion disposed within the external portion. Each of the first lingual wall and the second lingual wall may have a contoured surface. Each of the first facial wall and the second facial wall may have a contoured surface. Each of the first body and the second body capable of biased engagement with a wearer's teeth. The first lobe and the second lobe may have a first portion and a second portion. The first and second lobes may curve to a lower elevation. The first and second lobes being disposed at an elevation below the connector. The connector may have a flat upper surface. The first occlusal surface and the second occlusal surface may be a flat surface. The first and second lingual walls may have a height that is less than the first and second facial walls. The oral appliance may be formed of a first material and a second material.

According to some embodiments, an oral appliance may comprise an external portion and an internal portion disposed within the external portion, the external portion having: a first body and a second body and connector extending between, the internal portion having: an internal support disposed within each of the first body and the second body, and a connector support disposed within the connector, the connector support extending between the internal supports. A first lobe may extend from a lower facial anterior corner of the first body and a second lobe extending from a lower facial anterior corner the second body. The connector may extend from an upper lingual anterior corner of the bodies.

According to some optional embodiments, the following features may be combined with the oral appliance either individually or in combination with other of the following optional features and the oral appliance. The internal supports may each have at least one support bar extending therefrom and disposed within the external portion. The first body and the second body each may have a either a flat or wedge shaped occlusal surface. The external portion may be formed of a first material and the internal portion being formed of a second material. The first material may be a VISTAMAXX and the second material being an EVA.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of an oral appliance will now be described by way of examples. These embodiments are not to limit the scope of the claims as other embodiments of an oral appliance will become apparent to one having ordinary skill in the art upon reading the instant description. Non-limiting examples of the present embodiments are shown in figures wherein:

DETAILED DESCRIPTION

Figure 1:
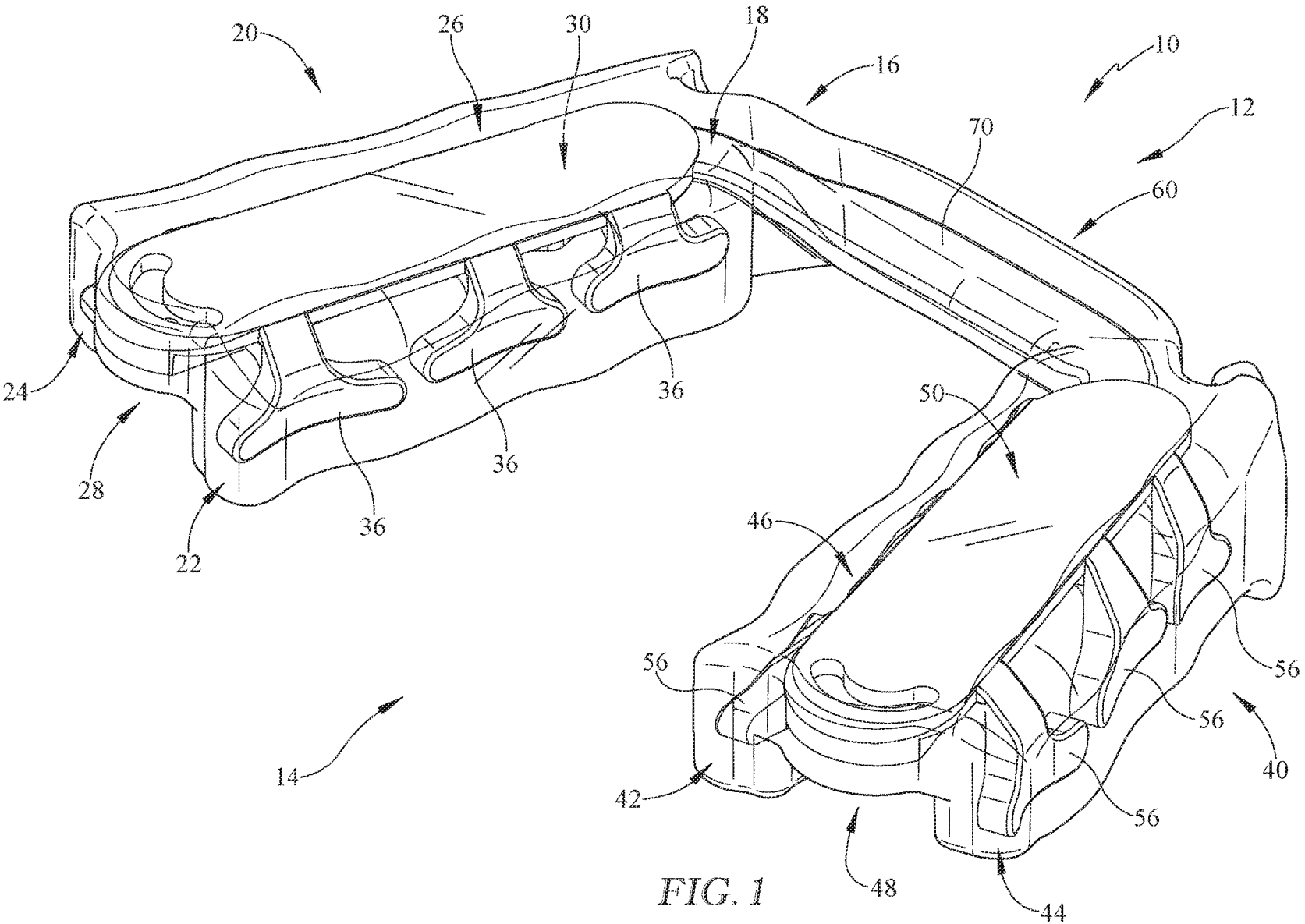
FIG. 1 is a first perspective view of the oral appliance.

It is to be understood that an oral appliance is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

With reference to FIGS. 1-7, present embodiments related to oral appliances which improve aerobic performance by reducing respiratory rates, increasing airflow to the lungs, reducing cortisol build up and improving muscle endurance.

As used herein, ventilation is the measure of air into and out of the lungs, and respiratory rate is the measure of the exchange of oxygen and carbon dioxide within the lungs. Specifically, ventilation is the defined as the liters per minute. Respiratory rate is defined herein as breaths per minute. Tidal volume is defined herein as the volume of air inhaled and exhaled during one breath.

Anterior, as used herein, refers to portions of the mouth proximate the front of the mouth for example, proximate the lips or the front incisors. Posterior, as used herein, refers to the back of the mouth, for example, proximate the 3rd molar (if present) or the pharynx. Mesial, as used here, refers to the midline of the mouth. The central incisors are usually located on either side of the mesial line or midline. For example, a structure that extends mesially may extend toward the mesial line or midline, and a structure that is positioned mesially may be positioned about the mesial line or midline. Axial, as used herein, refers to directions along a vertical axis of the body as, for example, generally defined by the spinal column.

A forward shift of the mandible such as may occur with the dental appliance implementations disclosed herein may increase the pharyngeal area. Applicant has found airway anatomical differences with various implementations of the dental appliance, specifically measuring the diameter and width of the oropharynx with computed tomography (CT) scans that demonstrated an average 9% improvement in both the diameter and width when subjects used the dental appliance. (See Garner, D. P. and McDivitt, E., Effects of mouthpiece use on airways openings and lactate levels in healthy college males. Compendium: A Supplement of Continuing Education in Dentistry, 30(2): 9-13 (2009)).

Finally, it was found that implementations of the dental appliance that allowed subjects to clench all their teeth evenly with vertical displacement and a level pressure distribution between all teeth resulted in increased respiratory performance and desirable cortisol changes.

With reference now to FIG. 1, a perspective view of an oral appliance 10, also referred to as a dental appliance, is provided. The example is non-limiting and comprises a first body 20 and a second body 40 which are connected by a connector 60. The bodies 20, 40 and the connector 60 define an external portion 16 and the oral appliance 10 may also comprise an internal portion 18 disposed within the external portion 16. The bodies 20, 40 and connector 60 are joined to define a U-shaped structure which may be positioned within a user's mouth. The oral appliance 10 has an anterior end 12, oriented toward the front of a user's mouth, and a posterior end 14, oriented toward the rear, interior of a user's mouth.

The bodies 20, 40 are generally shaped as a u-shaped or n-shaped members which extend between the anterior and posterior ends 12, 14. The bodies 20, 40 each are formed to fit over one or more of the user's teeth. For example, the bodies 20, 40 of oral appliance 10 engage the mandibular 1st bicuspid, mandibular 2nd bicuspid, mandibular 1st molar, mandibular 2nd molar, and mandibular 3rd molar on the right and left sides, respectively.

Each body 20, 40 comprises a lingual wall 22, 42 respectively, a facial wall 24, 44 respectively and an occlusal surface 26, 46 respectively extending between the lingual wall and the facial wall. Each of the lingual walls 22, 42 and the facial wall 24, 44 are oriented in a generally vertical orientation. The occlusal surfaces 26, 46 join the lingual walls 22, 42 and facial walls 24, 44, of each body 20, 40 and are oriented generally horizontally. The occlusal surfaces 26, 46 may be tapered from a thicker (vertically) location to a thinner location in a front to rear direction or in a rear to front direction.

Each body 20, 40 generally defines a dental trough 28, 48 between the respective walls and occlusal surface. The dental troughs 28, 48 each provide a location wherein the user's one or more teeth may be located. The dental trough 28, 48 may be fit to the user's teeth in order to conform to the shape of the user's teeth including interstices between the user's teeth.

The body 20, 40 may be formed of one or more materials. In various aspects, the body material may be transformable between a pliable state and a non-pliable state. In the pliable state, the bodies 20, 40 or the occlusal surfaces 26, 46 of the bodies 20, 40 may be shaped to conform to the one or more teeth of the user. In the non-pliable state, the bodies 20, 40 generally retain its conformance to the teeth of the user as shaped when in the pliable state. In various aspects, the occlusal surfaces 26, 46 may be transformed between the pliable state and the non-pliable state by heating and cooling, respectively. For example, heating the occlusal surfaces 26, 46 material in warm water may allow the occlusal surface 26, 46 to be fitted to the user's teeth and, after having been fitted, the occlusal surface material may be cooled to the non-pliant state thereby capturing the fit of the user's teeth in the occlusal pad material. The occlusal surfaces 26, 46 materials are transformed from the non-pliable state to the pliable state at a temperature tolerable by the user upon placement of the occlusal pad material in the pliable state within the user's mouth, in various aspects. The occlusal surfaces 26, 46 materials may transform between the non-pliant and pliant state at a temperature greater than human body temperature but less than about 100° C., in various implementations.

The oral appliance 10 may be formed of various materials. In some embodiments, the oral appliance may be formed of a single material. In some embodiments, the oral appliance may be formed of two or more materials. The two or more materials may be entirely different materials or may be differing grades of the same material. Various combinations may be utilized.

In some embodiments, the oral appliance 10 material may include a mixture of polycaprolactone. An exemplary polycaprolactone is Capra 6500 polycaprolactone from Perstorp, UK Limited, Warrington, Cheshire UK. In various aspects, the oral appliance 10 includes a mixture of polycaprolactone and ethylene vinyl acetate (EVA) such as ELVAX®. In various aspects, the occlusal pad material of body includes ethylene vinyl acetate (EVA) alone, such as ELVAX®. In various aspects, the body may include a mixture of polycaprolactone and a polyolefin elastomer, and the polyolefin elastomer may be a copolymer of ethylene and octene-1. An exemplary copolymer is available as ENGAGE® from Dupont Canada, Inc., P.O. Box 2200, Streetsville, Mississauga, Ontario L5M 2H3.

For example, in some embodiments, the material may include ethyl-vinyl acetate (EVA); thermoplastic polyolefin, various ethylene-based elastomers; various hydrocarbon resins (which are may be combined with EVA, thermoplastic polyolefin, or various ethylene-based elastomers), polycaprolactone (which may be combined with EVA), low-density polyethylene, high density poly-ethylene, polycarbonate and/or various polymers, laminates and other materials that will be recognized by those skilled in the art upon review of the present disclosure. In embodiments, the composite material may be a pre-laminated sheet including a layer of polycarbonate bound to a layer of polyester urethane which is available under the trade name Durasoft® from the Scheu Dental Co. located in Iserlohn, Germany. Typically, these materials may be selected with a durometer (hardness) of between about 70 A to about 96 A or between about 55D and about 90D.

In some embodiments, an additional material may be added to the occlusal surface of each body 20, 40 to define a bite pad. It may be desirable that the occlusal surface 26, 46, or the bite pad, or both, be formed of a material having preselected properties for example to better interact with teeth. The occlusal surface, or a bite pad build-up of material, or both may be formed of material including a mixture of styrene block copolymer and ethylene vinyl acetate (EVA). An exemplary styrene block copolymer is available as DYNAFLEX® part number G2782 from GLS Corporation, Thermoplastic Elastomers Division, 833 Ridgeview Dr., McHenry, Ill. 60050. EVA is available from a number of sources, such as the ELVAX® resins from Dupont Packaging and Industrial Polymers, 1007 Market Street, Wilmington, Del. 19898.

In some other embodiments, the oral appliance 10 may be formed of a polyolefin elastomer such as a copolymer of ethylene and octene-1. An exemplary copolymer is available as ENGAGE® from Dupont Canada, Inc., P.O. Box 2200, Streetsville, Mississauga, Ontario L5M 2H3. In other embodiments, the oral appliance 10 may be formed of a thermoplastic rubber, which may be a thermoplastic elastomer and a thermoplastic urethane with polyolefin elastomers such as Santoprene® thermoplastic elastomer from Advanced Elastomer Systems, L. P., 388 South Main Street, Akron, Ohio 44311 and Kraton® thermoplastic elastomer from the Shell Oil Company, Houston, Tex. Kraton® includes a styrene-ethylenelbutylenes-styrene block copolymer. In various aspects, the occlusal surface, an optional bite pad, or both material may include polypropylene part number AP6112-HS from Huntsman Corporation, Chesapeake, Va. 23320. In various aspects, the bite pad material may include HD-6706 ESCORENE® Injection Molding Resin [a high-density polyethylene] from ExxonMobil Chemical Company, P.O. Box 3272, Houston, Tex.

Additionally, in some embodiments, the bodies 20, 40 and connector 60 may be formed of VISTAMAXX. The polymer blend of the moldable portion, for example bodies 20, 40, and connector 60 may include one or more grades of Vistamaxx™ produced by ExxonMobil of Houston, Tex. 77253. Table 1 includes a listing of various grades of Vistamaxx™ that may be used in the moldable portion and various respective properties, including ethylene content, Vicat softening point (ASTM D 1525), flexural modulus, and hardness (ASTM D2240) Shore D/A. The grades of Vistamaxx™ provided in Table 1 are merely illustrative, non-exhaustive, and should not be considered limiting.

TABLE 1

| Grade Name | Ethylene Content (weight %) | Vica Softening Point ASTM D 1525° C. (° F.) | Flexural Modulus-1% Secant (psi) | Hardness 15 sec ASTM D2240 Shore D/A |
|---|---|---|---|---|
| 3588 | 4 | 103 (217) | 58400 | 50D (Very hard) |
| 3980FL | 9 | 77.3 (171) | 17000 | 34D (Hard) |
| 3000 | 11 | 65.0 (149) | 9050 | 27D (Soft/Hard) |
| 6502 | 13 | 51.4 (125) | 2960 | 71 (Soft) |
| 6102 | 16 | 53.0 (129) | 2090 | 67A (Soft) |

In some instances, it may be desirable to blend two or more grades of Vistamaxx™ at varying percentages in order to achieve a desired level of hardness and/or impact resistance of the composition of the moldable exterior portion.

The oral appliance 10 for example may be made from a thermoplastic polyolefin elastomer may be formed in some non-limiting examples as set forth in Table 2. The oral appliance of VISTAMAXX comprises physical and mechanical properties that match or surpass prior art EVA mouthpieces. The oral appliance 10 may provide a greater rate of crystallization or fitting time, i.e., the time interval before the material stiffens at body temperature, which improves fitting of the oral appliance. Oral appliance 10 takes 2 to 3 minutes for the mouthguard to harden providing the user ample time to properly fit the mouthguard. During this time interval, the material remains soft and extensible. In addition, the high shrinkage of oral appliance 10 allows the device to shrink, giving a snug fit with excellent retention to the teeth and jaw within 5 minutes.

TABLE 2

| Physical and Mechanical Properties | |
|---|---|
| Density, g/cc | 0.86-0.89 |
| Melting Point ° C. | 55-160 |
| Tensile Strength (psi) | 2200-4500 |
| Die C Tear Strength (ibf/in) | 130-330 |
| Elongation at Break (%) | 100-1500 |
| Flexural Modulus (psi)) | 1500-6500 |
| Hardness (Shore A) | 50-90 |
| Shrinkage to teeth | Excellent |
| Overall fitting time | 2-3 minutes |

The connector 60 extends between the first body 20 and the second body 40. The connector 60 extends from or near an upper lingual corner of each body 20, 40. More specifically, the connector 60 may extend from the anterior lingual end each of body 20, 40. The connector 60 has a thickness in the anterior—posterior direction which may be constant or may vary. In some embodiments for example, the connector 60 is shown thinner, horizontally, at the ends near the bodies 20, 40 and is thicker at the central area of the connector 60 between the bodies 20, 40.

In some embodiments, the oral appliance 10 may be formed of two materials. For example in some embodiments, the bodies 20, 40 and connector 60 define the external portion 16 and may be formed of an exterior material, for example VISTAMAXX and further comprise an internal portion 18 formed of internal supports 30, 50 and a connector support 70 formed of an EVA.

The internal support 30 is located within the body 20 and the internal support 50 is located within the body 40. The internal supports 30, 50 may be flat or wedge shaped with a taper in a length-wise direction and may have a length that extends through the bodies 20, 40. The internal supports 30, 50 may be elongate and in some embodiments have rounded ends.

Extending from each of the supports are a plurality of support bars 36, 56. The support bars 36, 56 may be various shapes but in some embodiments may be T-shaped. In the depicted embodiment, the support bars 36, 56 may be located on the lingual side, the facial side or both of the internal supports 30, 50. In some embodiments, the support bars 36, 56 may be T-shaped to improve stability to the side walls 22, 24, 42, 44 when the user microwaves and forms the guard. These support bars 36, 56 also inhibit the walls 22, 24, 42, 44 from collapsing when the user bites down and smashes the sidewall to the bite pad roof.

Further, each of the supports 30, 50 may be joined by a connector support 70. The connector support 70 is depicted internally of the connector 60. In some embodiments, the internal supports 30, 50 and the connector support 70 are formed as a single structure. Once the internal supports 30, 50 and the connector support 70 are formed, the bodies 20, 40 and the connector 60 are formed thereabout. This may be in a single mold for example where the internal supports 30, 50 and connector 70 are first formed then a second molding occurs. Alternatively, the oral appliance 10 may be formed in separate molds wherein the internal portions formed in a first mold and then the are located in a second mold for formation of the bodies 20, 40 and connector 60.

Additionally, the oral appliance 10 may be opaque or may be semi-transparent, or may be some combination. For example, present embodiments have an external portion 16 which is semi-transparent with the internal portion 18 being opaque. This provides visual indication of the two materials used in some embodiments.

Figure 2:
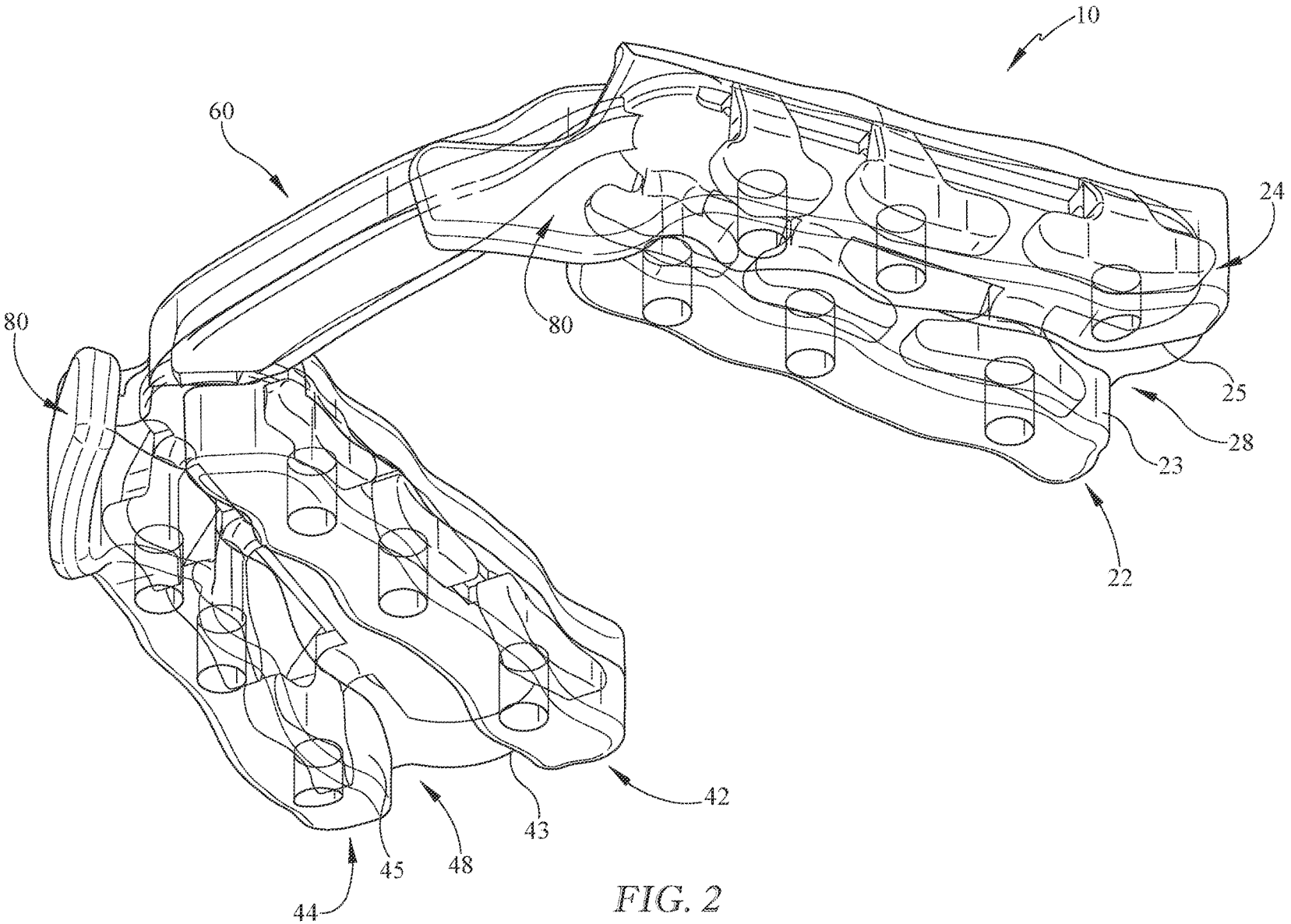
FIG. 2 is a second perspective view of the oral appliance.

Referring now to FIG. 2, the oral appliance 10 is shown in a second perspective view. In the lower perspective view, the connector 60 is again shown. In a vertical direction, the connector 60 may have a constant or varying thickness, and in the instant embodiment, for example, the vertical thickness is generally constant.

Also shown in this view, the facial walls 24, 44 each further comprise a lobe 80. Extending from the anterior end 12 of the facial walls 24, 44, the lobes 80 extends downward and in an anterior direction of the oral appliance 10. The lobes 80 may improve retention on the teeth in the area of the lobes and along the facial surface of such teeth. The lobes 80 may also push the lower lip outward slightly. Additionally, a space is formed between the lobes 80 and the lingual walls 22, 42, creates a space for teeth and aid to retain the oral appliance 10 in position due to engagement with the teeth in the area of the lobes 80.

With reference again to the first body 20 and second body 40, the bodies each comprise the dental trough 28, 48 respectively, which allows for positioning of one or more of the user's teeth. The inward facing surface 23, 25, 43, 45 of each of the lingual and facial walls 22, 24, 42, 44 may be contoured, varying the width of the dental troughs 28, 48. With the varying thickness of each dental trough 28, 48, the lingual and facial walls of each body 20, 40 provide biased engagement of the user's teeth. The varying width and contours may be shaped to conform to the user's one or more teeth. For example, the contours may be formed to engage and conform to the cusps of the user's teeth. Additionally, the upper surface of the dental trough may be also shaped to conform to the occlusal surfaces of the one or more teeth disposed within each dental trough of each body. The conformances to the user's one or more teeth may more evenly distribute the force from clenching or impact and improve retention and fitment of the oral appliance. In some other embodiments, the lingual and facial walls may be of constant thickness.

Also shown in the depicted figure, the outer facial walls 24, 44 of each body 20, 40 and the lingual walls 22, 42 are also contoured. The contour of the outer surfaces of the facial walls 24, 44 may be formed to replicate the contours of the user's teeth in the area where the oral appliance 10 is mounted.

Figure 3:
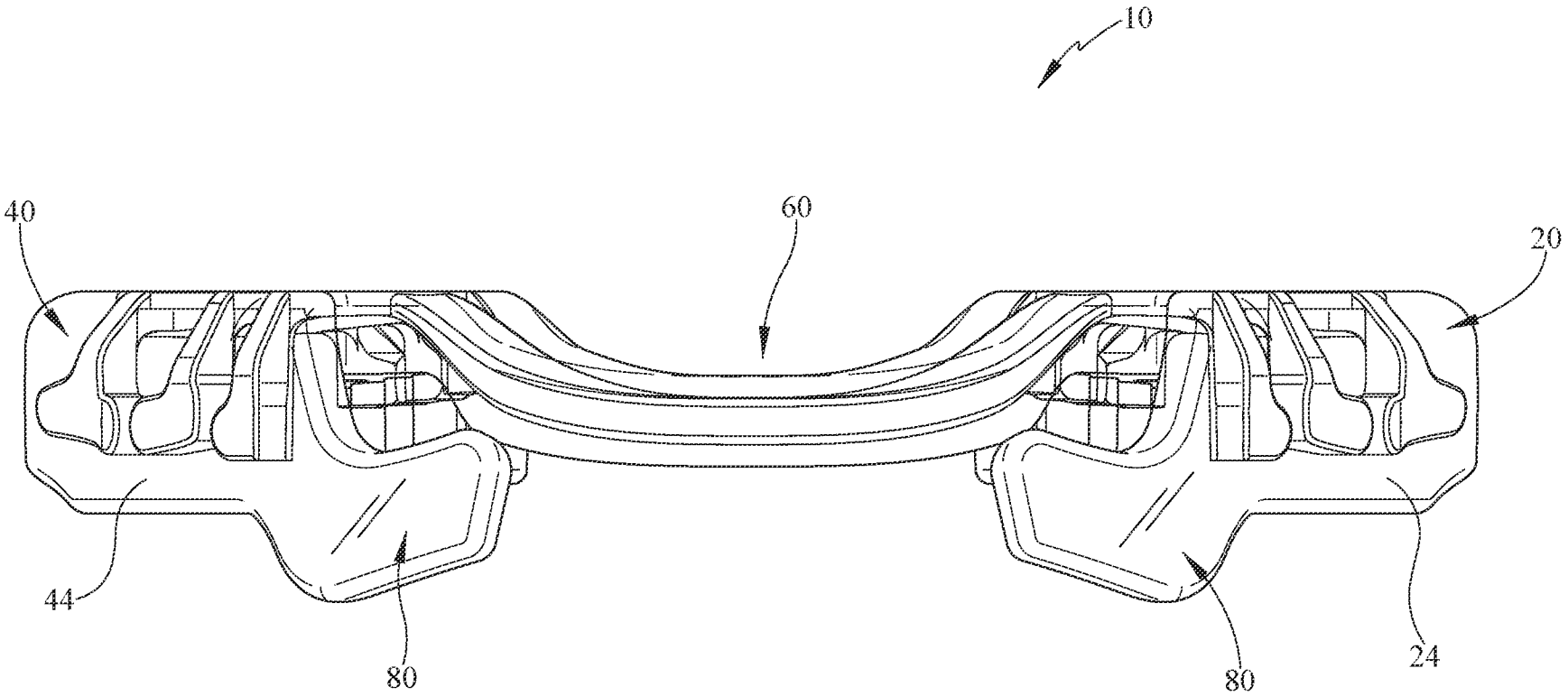
FIG. 3 is a front elevation view of the oral appliance.

Referring now to FIG. 3, a further embodiment is shown in front view of the oral appliance 10. In this view, the lobes 80 are shown depending from the lower anterior corners of the facial walls 24, 44. The lobes 80 may be linear or may be curved to place a retention force on the on the facial side of the teeth of gums in the area of the lobes 80. The lobes 80 also are at least partially positioned below a lower edge of each body 20, 40 and therefore are vertically lower than the connector 60.

Also shown in the view, the connector 60 extends from the upper anterior corners of the lingual walls 22, 42, and drops slightly in elevation before extending across the forward portion of the oral appliance 10. When viewed in combination with the perspective view of FIGS. 1 and 2, the lobes 80 are disposed forward or anterior of the connector 60, creating the space for teeth therebetween.

Figure 4:
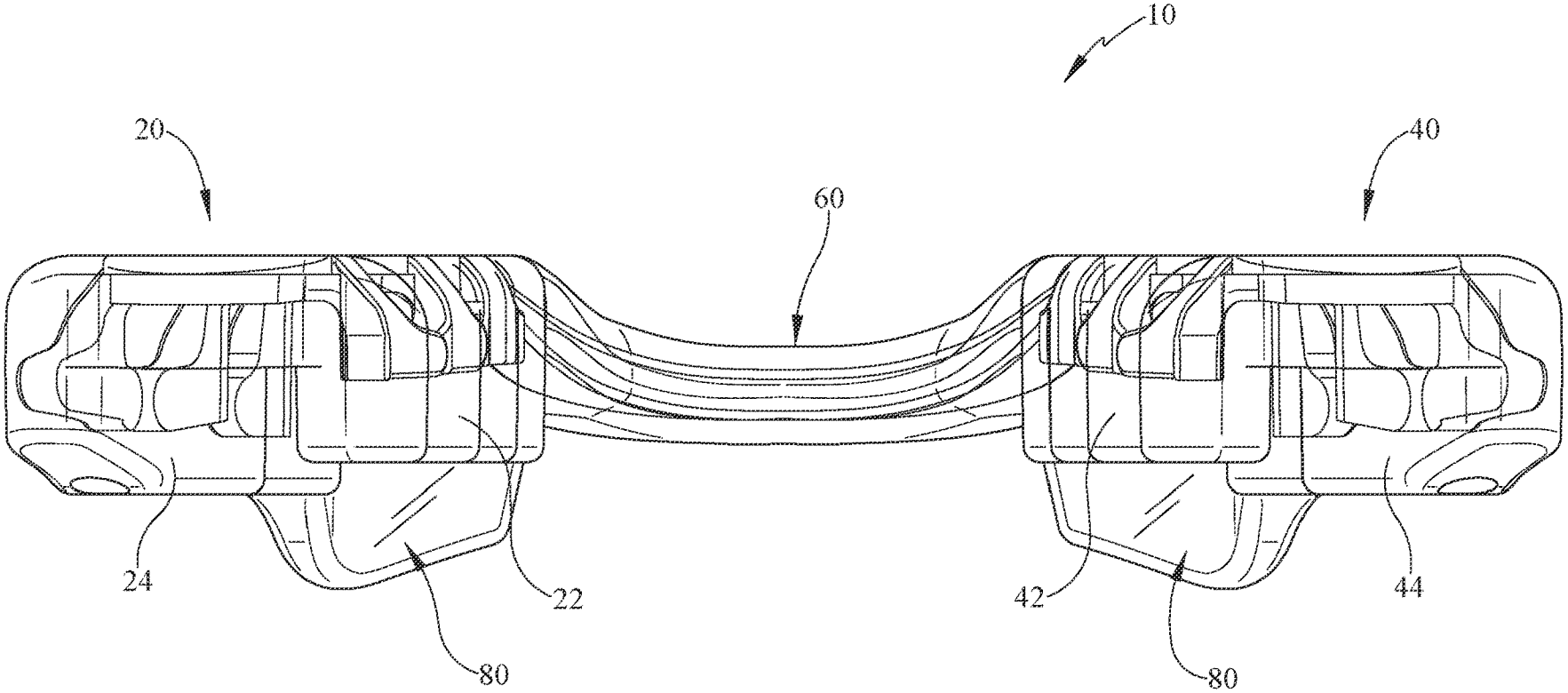
FIG. 4 is a rear elevation view of the oral appliance.

Referring now to FIG. 4, a rear view of the oral appliance 10 is shown. In some embodiments, the lingual walls 22, 42 are shorter in height than the facial walls 24, 44 of each body 20, 40. Accordingly, when depending from the occlusal surfaces 26, 46, facial walls 24, 44 depend downwardly farther than the lingual walls 22, 42. In some other embodiments, the walls 24, 44 may be of the same height and therefore depend the same distance downward.

Also shown in this view, the lobes 80 are disposed below the connector 60 such that the lower edge of lobes 80 are lower than the connector 60 and additionally lower than the facial and lingual walls.

Figure 5:
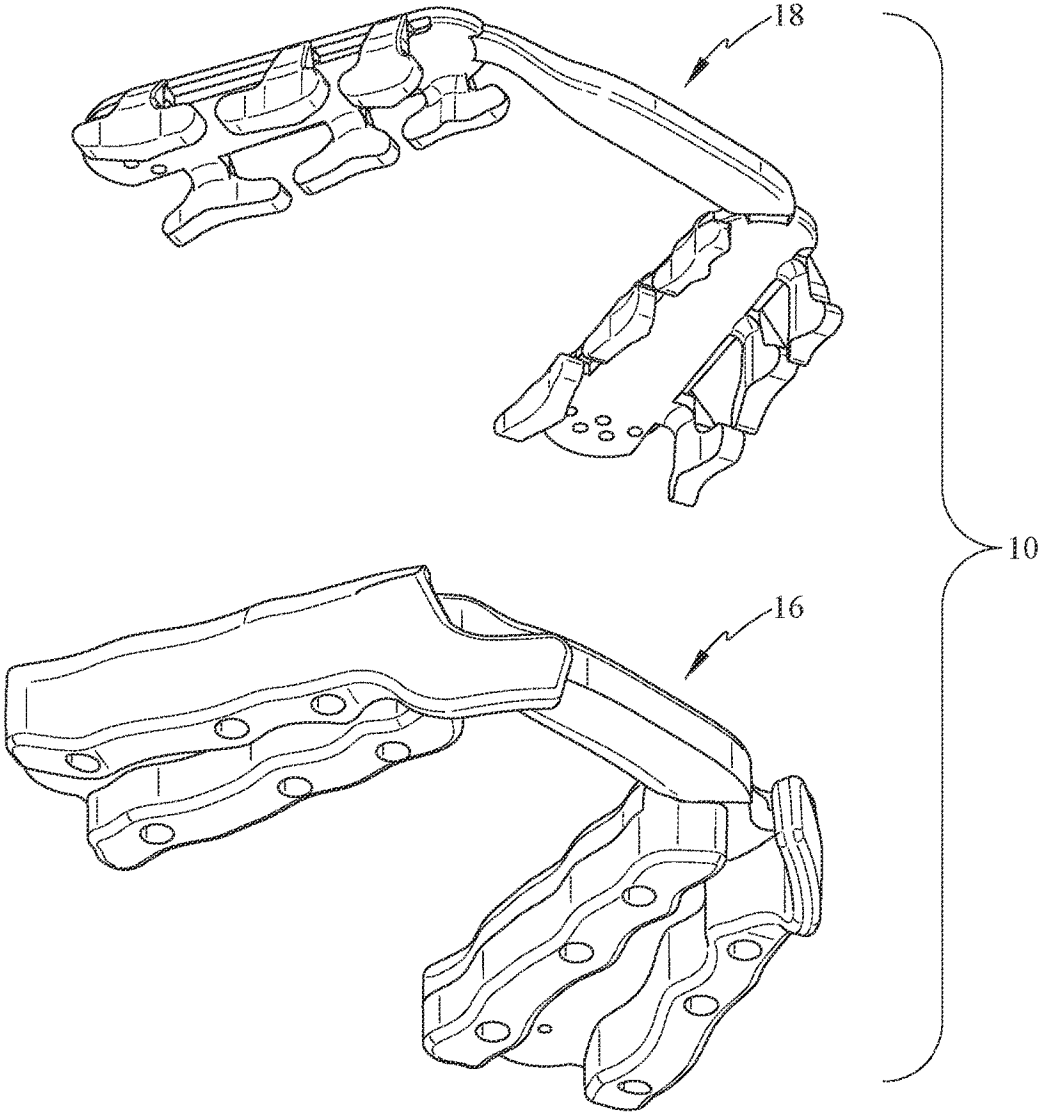
FIG. 5 is an exploded perspective view of the internal and external portions of the oral appliance; and, FIG. 6 is a perspective view of the oral appliance disposed in an example mouth; and, FIG. 7 is a view of the user's airway increase.

With reference now to FIG. 5, an exploded view of the oral appliance 10 is depicted with the internal portion 18 removed from the external portion 16. As shown in this embodiment, the internal portion 18 is shown in its formed condition before the external portion 16 formed around internal portion 18. As noted previously, the internal portion 18 may be formed first and then placed in a mold for a second process wherein the exterior portion 16 (bodies 20, 40, and connector 60) are formed. The internal portion 18 may be formed in a first mold and then moved to a second mold for forming of the exterior portion 16. Or alternatively, the internal portion 18 may be formed and the second molding of the exterior portion 16 occur in the same mold.

Figure 6:
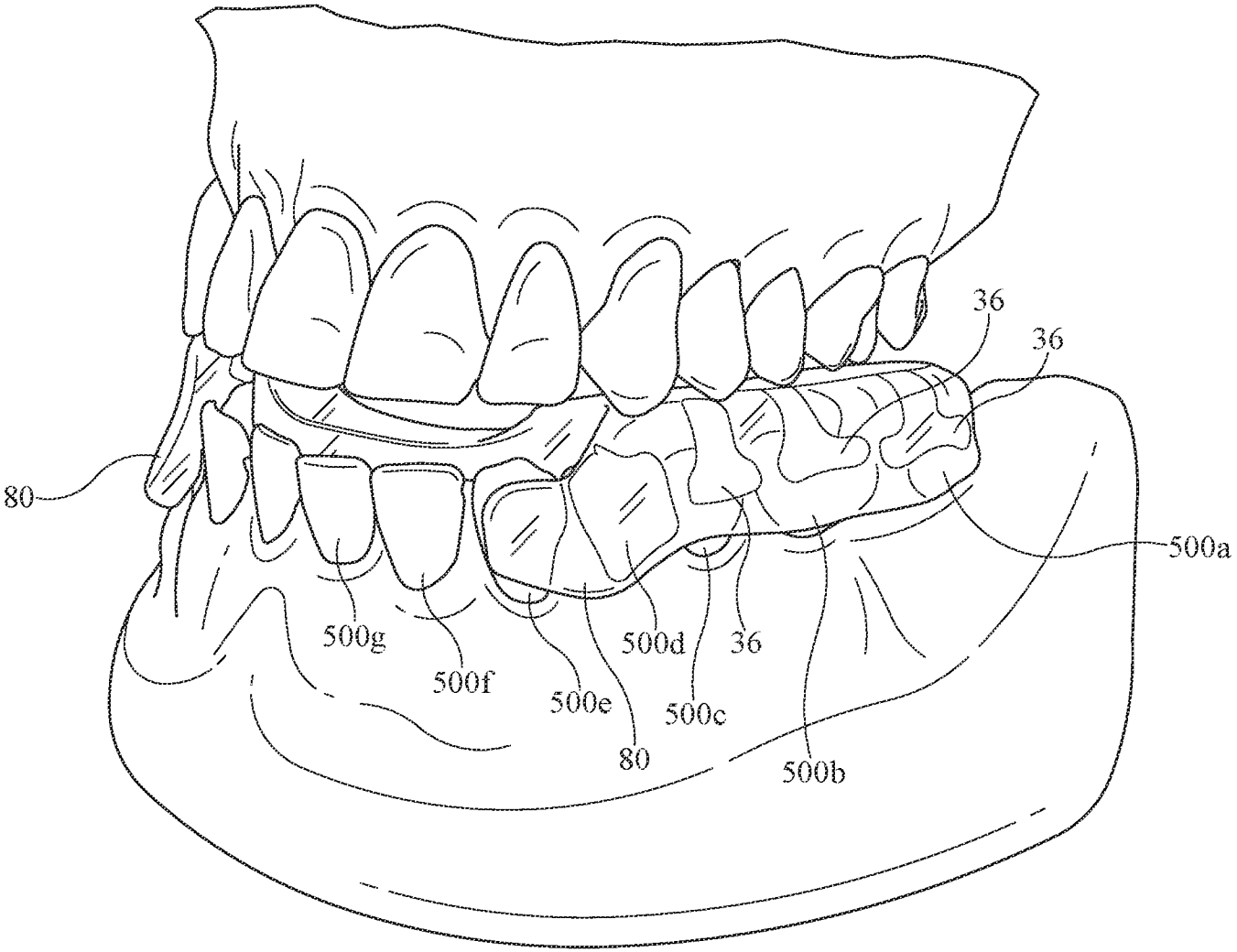

With reference to FIG. 6, a perspective view of the oral appliance 10 is depicted on the lower mandibular area of the user's mouth. The bodies 20, 40 of dental appliance 10 or the lobes 80 may engage the mandibular teeth. In the depicted embodiment, the mandibular teeth may be selected from one or more of tooth 500*a*, 500*b*, 500*c*, 500*d*, 500*e*, 500*f*, 500*g*, where these teeth are the left mandibular 2nd molar, left mandibular Pt molar, left mandibular 2nd bicuspid, left mandibular Pt bicuspid, left mandibular cuspid, left mandibular lateral incisor, left mandibular central incisor, respectively. The same teeth may be engaged on the right side. Also shown in this view, the connector 70 is disposed behind the anterior teeth and the teeth 500*d*, 500*e* are disposed between the bole 80 and the connector 70.

Figure 7:
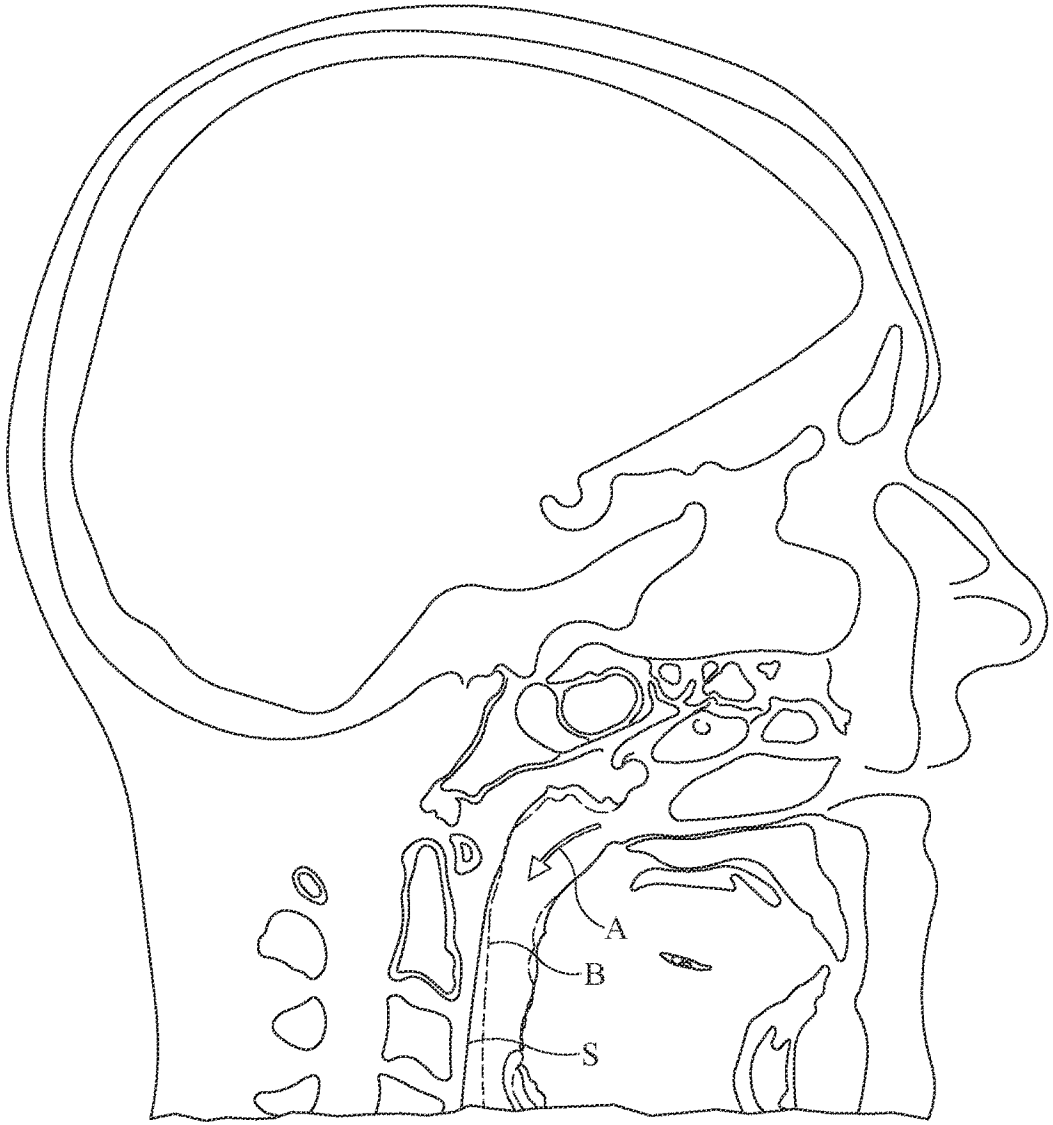

With reference now to FIG. 7, a side section view of a user or wearer is shown. The view depicts two opening sizes of the airway A in the throat area. The opening is shown in broken line B in a first position and in solid line S in a second position. The broken line B represents the air way in a normal position without the oral appliance 10 in place. The solid line S represents the airway in a second position with the oral appliance 10 in place in the user's mouth. With the oral appliance 10 in use, the jaw is pushed forward, causing additional opening of the airway A for improved breathing. This is achieved by opening of the airway A. Breathing performance can improve up to 20 percent and on average about 10 percent.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An oral appliance, comprising:

a first body which is configured to be positioned on a wearer's lower teeth having a first lingual wall extending between an anterior direction and a posterior direction and a first facial wall extending between said anterior direction and the posterior direction;

a first occlusal surface extending between said first lingual wall and said first facial wall, said first facial wall and said first lingual wall depending from said first occlusal surface a second body which is configured to be positioned on the wearer's lower teeth having a second lingual wall extending between the anterior direction and the posterior direction and a second facial wall extending between the anterior direction and the poste rior direction;

a second occlusal surface extending between said second lingual wall and said second facial wall, said second facial wall and said second lingual wall depending from said second occlusal surface;

a connector extending between said first body and said second body at upper lingual corners of said first and second bodies, an upper surface of said connector being substantially flat and said connector having a higher elevation at said first and second bodies and a lower elevation between said first and second bodies, and having an upper surface along said lower elevation, a portion of said upper surface being horizontally planar in an anterior to posterior direction; and, a first lobe extending from a lower facial anterior corner of said first facial wall and a second lobe extending from a lower facial anterior corner of said second facial wall, each of said first and second lobes having a first portion extending downwardly and a second portion extending in an anterior direction, each of said first and second lobes spaced from said connector and configured to receive one or more of the wearer's lower teeth between said connector and each of said first and second lobes, said first lobe and said second lobe being integrally formed of a same material as said first body, said second body and said connector.

2. The oral appliance of claim 1, said first body, said second body, and said connector defining an external portion.

3. The oral appliance of claim 2, further comprising an internal portion disposed within said external portion.

4. The oral appliance of claim 2, each of said first facial wall and said second facial wall having a contoured surface.

5. The oral appliance of claim 4, each of said first lingual wall and said second lingual wall having a contoured surface.

6. The oral appliance of claim 1, each of said first body and said second body capable of biased engagement with the wearer's lower teeth.

7. The oral appliance of claim 1, said first and second lobes curving to a lower elevation.

8. The oral appliance of claim 1, said first and second lobes being disposed at an elevation below said connector.

9. The oral appliance of claim 1, said lower elevation of said connector having a flat upper surface from an anterior edge to a posterior edge.

10. The oral appliance of claim 1, said first occlusal surface and said second occlusal surface being a flat surface.

11. The oral appliance of claim 1, said first and second lingual walls having a height that is less than a height of said first and second facial walls.

12. The oral appliance of claim 3, said external portion being formed of a first material and said internal portion being formed of a second material.

13. An oral appliance, comprising:

an external portion and an internal portion disposed within said external portion for positioning on lower teeth of a wearer, said external portion having:

a first body and a second body and connector extending between;

each of said first body and said second body comprising a facial wall and a lingual wall depending from an occlusal surface;

said internal portion having:

an internal support disposed within each of said first body and said second body, and a connector support disposed within said connector, said connector support extending between said internal supports;

a first lobe extending from a lower facial anterior corner of said first body and a second lobe extending from a lower facial anterior corner of said second body, each of said first and second lobes having a first portion extending downwardly and a second portion extending in an anterior direction;

said connector extending from an upper lingual anterior corner of each of said first and second bodies and having a lower elevation between said first and second bodies wherein at least a portion of an upper surface of said connector along said lower elevation is horizontally planar in an anterior to posterior direction, said connector configured to be positioned posterior of front teeth of said wearer and said first lobe and said second lobe configured to be positioned anterior of at least a portion of said connector;

wherein said external portion of each of said first body, said second body, said connector, said first lobe and said second lobe form a monolithic unitary structure.

14. The oral appliance of claim 13, said external portion formed of a first material and said internal portion being formed of a second material.

15. The oral appliance of claim 14, said first material being a thermoplastic polyolefin elastomer and said second material being an ethylene vinyl acetate (EVA).

16. The oral appliance of claim 13, said internal supports each having at least one support bar extending therefrom and disposed within said external portion.

17. The oral appliance of claim 13, said occlusal surface of said first body and said second body each having either a flat or wedge shape.

18. An oral appliance, comprising:

a first body having a first lingual wall extending between an anterior direction and a posterior direction and a first facial wall extending between said anterior direction and the posterior direction;

an first occlusal surface extending between said first lingual wall and said first facial wall;

a second body having a second lingual wall extending between the anterior direction and the posterior direction and a second facial wall extending between the anterior direction and the posterior direction;

a second occlusal surface extending between said second lingual wall and said second facial wall;

a connector extending between said first body and said second body at upper lingual corners of said first and second bodies, said connector having a lower elevation between said first and second bodies and a higher elevation at said first and second bodies, said connector having an upper surface that is horizontally planar in the anterior direction to the posterior direction along said lower elevation; and, a first lobe extending from a lower facial anterior corner of said first facial wall and a second lobe extending from a lower facial anterior corner of said second facial wall, said first lobe and said second lobe being formed of a same material as the first facial wall and the second facial wall, respectively, said first and second lobes spaced anteriorly of said connector and configured to receive a wearer's teeth between said first and second lobes and said connector, and said connector having a lower elevation than said lingual walls of said first and second bodies;

wherein said first body, said second body, said connector, said first lobe and said second lobe are a monolithic unitary structure formed of a same material;

wherein a wearer's airway is configured to open with use of said oral appliance.

* * * * *